United States Patent [19]

Buch et al.

[11] Patent Number: 4,807,458

[45] Date of Patent: Feb. 28, 1989

[54] DIVIDING GEAR UNIT FOR A ROLL BLOCK

[75] Inventors: Elmar Buch, Essen; Jürgen Greff, Karlsbrunn; René Marzinkewitsch; Herbert Vogelgesang, both of St. Ingbert, all of Fed. Rep. of Germany

[73] Assignee: Fried. Krupp Gesellschaft mit Beschrankter Haftung, Essen, Fed. Rep. of Germany

[21] Appl. No.: 886,530

[22] Filed: Jul. 16, 1986

[30] Foreign Application Priority Data

Jul. 18, 1985 [EP] European Pat. Off. ..... 85 108991.2

[51] Int. Cl.[4] ..... B21B 1/16; B21B 35/12

[52] U.S. Cl. ..... 72/235; 72/249; 74/665 F; 74/665 GA

[58] Field of Search ..... 72/235, 234, 249, 28; 74/665 F, 665 GA

[56] References Cited

U.S. PATENT DOCUMENTS

| | | | |
|---|---|---|---|
| 599,337 | 2/1898 | Kenworthy | 72/249 X |
| 2,629,272 | 2/1953 | Wood | 72/249 X |
| 2,953,942 | 9/1960 | Schwartz et al. | 74/665 GA |
| 4,112,722 | 9/1978 | Boucard | 72/249 X |

FOREIGN PATENT DOCUMENTS

| | | |
|---|---|---|
| 520470 | 6/1955 | Belgium . |
| 1452171 | 11/1968 | Fed. Rep. of Germany . |
| 2950106 | 7/1981 | Fed. Rep. of Germany . |
| 2369884 | 6/1978 | France . |

*Primary Examiner*—Robert L. Spruill
*Assistant Examiner*—Steven B. Katz
*Attorney, Agent, or Firm*—Herbert Dubno

[57] ABSTRACT

A roll block for rolling wire to final gauge in a high speed wire mill with a plurality of roll units alternatingly positioned at right angles to each other and behind each other, which are driven by two roll drive shafts running on both sides of the line of rolls parallel to it, includes a dividing gear unit for driving both drive shafts by a common drive motor. The individual roll units are connected to the roll drive shafts by miter wheel, bevel and/or other gear units. The gear ratios in the dividing gear unit on setting predetermined rotational speed ratios of the roll drive shafts lead to a predetermined series of caliber reductions for which the respective roll block is designed. Other materials and/or roll products require, if the gear ratios and rotational speeds are to be maintained constant, correspondingly changed dividing gear units. Such changes are no longer required when the dividing gear unit is a mechanical or hydraulic gearshift which produces different rotational speeds. A very fast and simple rotational speed change is allowed selectively by gear mechanisms operable by engaging and disengaging clutches between an input drive shaft, intermediate drive shafts and an output drive shaft.

3 Claims, 3 Drawing Sheets

FIG. 1
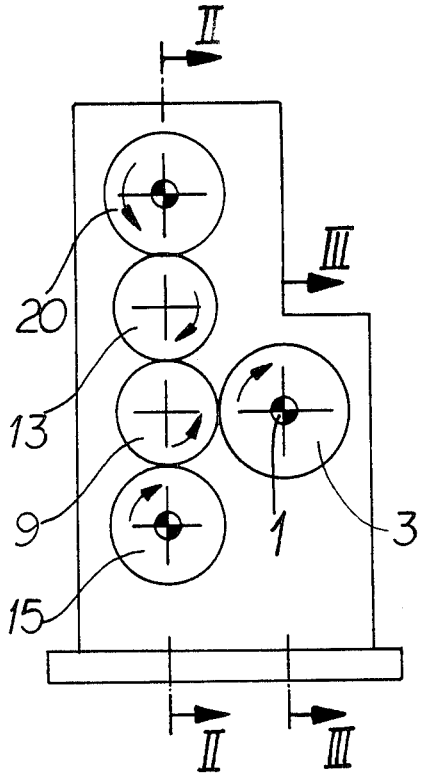
FIG. 2
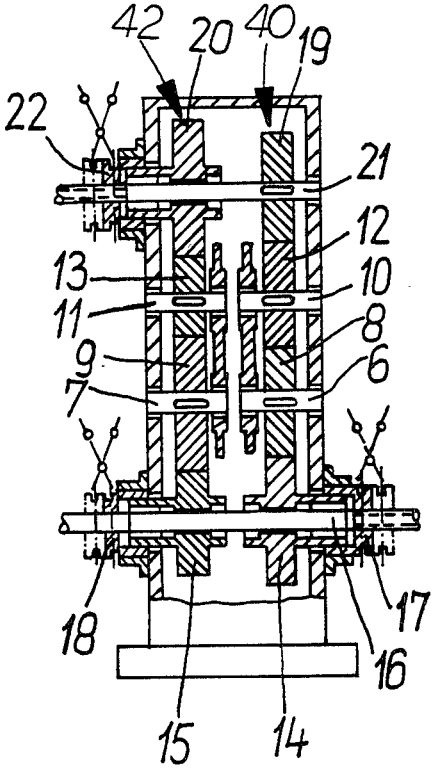
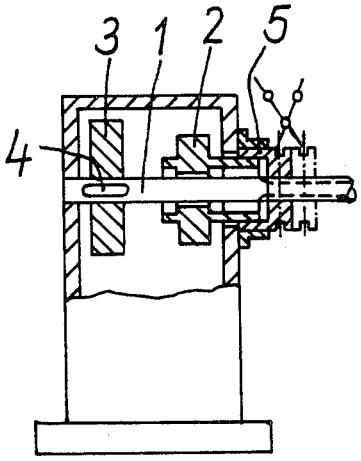
FIG. 3

DIVIDING GEAR UNIT FOR A ROLL BLOCK

FIELD OF THE INVENTION

Our present invention relates to a transmission gear or dividing gear unit and, more particularly, to a dividing gear unit for the roll drive shafts of a roll block, i.e. the unit which comprises a pair of wire-calibrating or rolling rolls and the drive therefor.

BACKGROUND OF THE INVENTION

For rolling wire to final gauge, i.e. for calibrating a rolled wire, in a high speed wire mill a plurality of roll units are oriented alternately at right angles to each other and positioned one behind another along the rolling line. The rolls are driven by two roll drive shafts running on opposite sides of the line parallel to it and with a connected dividing gear unit for driving both of the roll drive shafts of a common pair of rolls by a common drive motor.

In the past the connection of the individual roll units to the roll drive shaft has been effected by bevel gears. Thus the gear ratio for the gearing of the rolls can be set to provide the desired rotational speeds which are required for the respective roll units for certain quality materials and/or which result in a series of decreases in caliber of the products. Moreover a predetermined rotational speed ratio of both roll drive shafts to each other results when the gear ratio is set. When other materials are to be rolled and/or other products are to be made, of course, the provided bevel gearing and the rotational speed ratio of both drive shafts remains unchanged. However it is advantageous to change the rotational speed ratio of the roll drive shaft for different operating conditions. Therefore a variety of dividing gear units must be built to handle the variety of required conditions for operation.

OBJECTS OF THE INVENTION

It is the principal object of our invention to provide an improved dividing gear unit for a roll block which avoids the drawbacks of earlier units.

It is also an object of our invention to provide an improved dividing gear unit for a roll block which eliminates the need for a plurality of different dividing gear units to provide different speed ratios for the roll drive shafts.

It is a further object of our invention to provide an improved dividing gear unit for a roll block whose output drive shaft rotational speed ratio is adjustable by simple switching means.

SUMMARY OF THE INVENTION

These objects and others which will become more readily apparent hereinafter are attained in a dividing gear unit for a roll block for rolling wire to final gauge in a high speed-wire mill having a plurality of roll units disposed alternately at right angles to each other and positioned one behind the other and driven by two roll drive shafts on opposite sides of the rolling line parallel to it and with a connected dividing gear unit for driving both roll drive shafts by a common drive motor.

According to our invention the connected dividing gear unit is a gearshift producing different rotational speeds in both of the roll drive shafts but with constant rotational speed ratios for the roll drive shafts. The possibility of switching to different roll drive speeds guarantees that operation can continue as gauge decreases without structural changes in the gear and drive unit components. In this way it is possible to work with both standard steel and high grade (e.g. stainless) steel.

Advantageously the gearshift is a mechanical transmission gear with an input drive shaft and two output drive shafts connected to the roll drive shafts as well as two gear mechanisms selectively drivable by a plurality of engageable and disengageable clutches. This provides for two different roll drive shaft rotational speeds and also provides the preconditions for working with both high grade (e.g. stainless) steel and standard steel.

Also according to one embodiment of our invention between the input drive shaft and the output drive shafts two intermediate shafts are provided with at least two intermeshing gears mounted thereon associated with the gear mechanisms. This embodiment can be used to drive two roll drive shafts in opposite directions to each other.

In a particularly desirable simple embodiment of our invention, there is provided on an input drive shaft two gears directly meshing with two gears each mounted on each of two output drive shafts. The gear associated with one of the gear mechanisms on one of the output drive shafts and the gear associated with that gear mechanism on the other of the output drive shafts and a gear meshing with both of the gears on the output shafts are engageable and disengageable by the clutches. The mechanical gear unit according to our invention is both simple and easily understood as well as insensitive in operation. Also it requires little maintenance. According to operating conditions however it may be desirable to have each of the roll drive shafts associated with a hydraulic variable speed drive.

Instead of simply two variable speed gear devices according to our invention the input drive shaft of the dividing gear unit driven by the drive motor can be provided with a hydraulic variable speed gear device. Also these structures are very simple but do require a special hydraulic supply. Nevertheless they offer a suitable adjustability in the face of changing operating conditions.

BRIEF DESCRIPTION OF THE DRAWING

The above and other objects, features and advantages of our invention will become more readily apparent from the following description, reference being made to the accompanying highly diagrammatic drawing in which:

FIG. 1 is a side elevational view of a gearshift according to our invention with intermediate drive shafts;

FIG. 2 is a cross sectional view of the gearshift according to FIG. 1 taken along the section line II—II of FIG. 1;

FIG. 3 is a cross sectional view of the gearshift of FIG. 1 taken along the section line III—III of FIG. 1;

SPECIFIC DESCRIPTION

Figure 4:
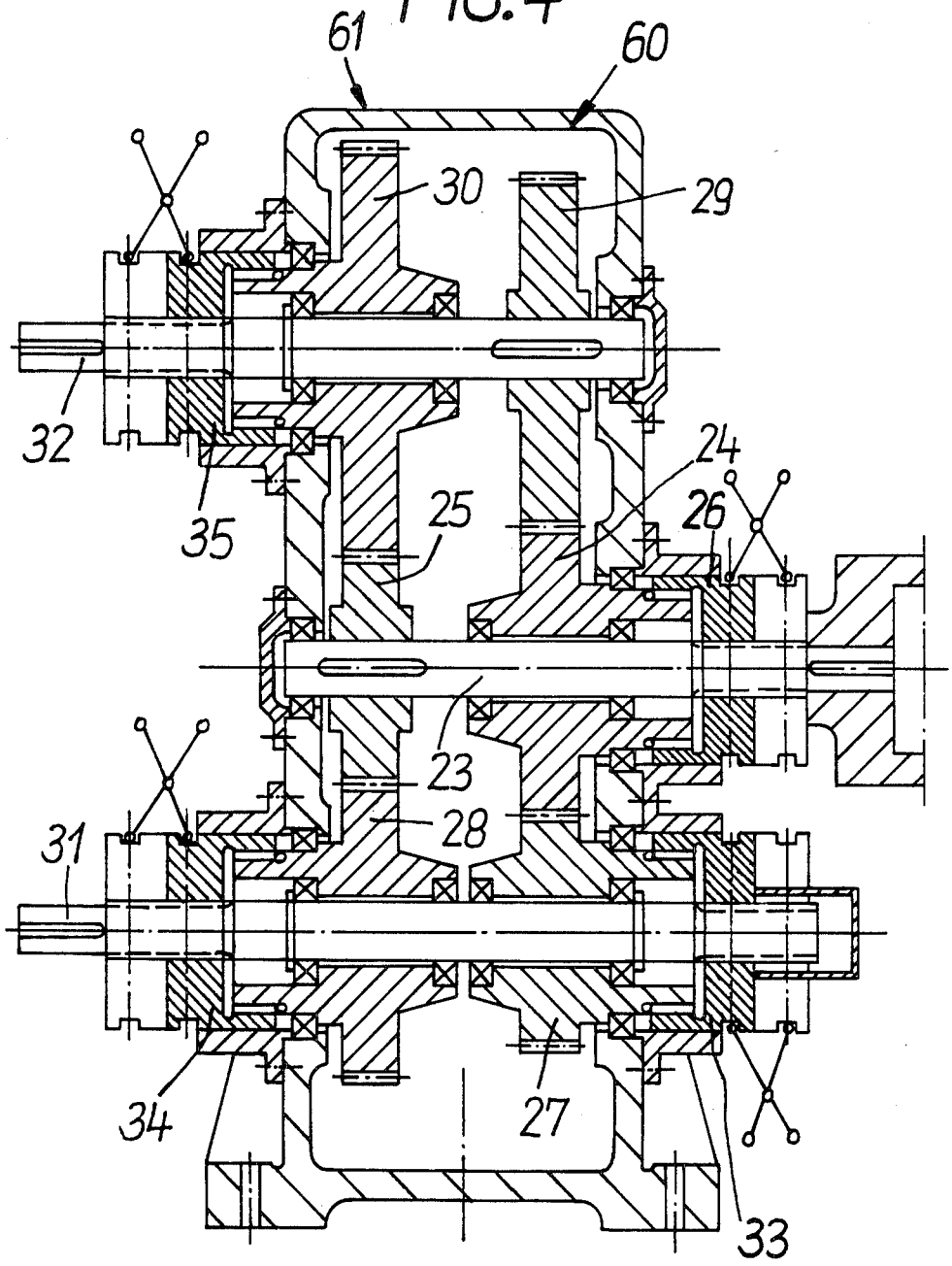
FIG. 4 is a cross sectional view through another embodiment of a gearshift according to our invention with directly meshing gears mounted on power input and output drive shafts.

In the gearshift according to FIGS. 1 to 3 which functions as our dividing gear unit a power input drive shaft 1 driven by a drive motor has two gears 2 and 3 mounted on it. The gear 3 is attached rigidly to the input drive shaft 1 by a key 4.

The gear 2 can be connected with the power input drive shaft 1 by a clutch 5. This rotary connection is released by disengaging the clutch 5 and moving the clutch into the position shown in dot-dashed lines in FIG. 3.

Gears 2 and 3 respectively, engage the gears 8 and 9 keyed to the intermediate shafts 6 and 7. The gears 8 and 9 mesh with gears 12 and 13 keyed to intermediate shafts 10 and 11 and also with gears 14 and 15 on an output shaft 16. Gears 19 and 20 on output drive shaft 21 mesh with gears 12 and 13. The gear 19 is keyed to the output shaft 21. The gear 20 is connected disengageably by a clutch 22 with the shaft 21.

Figure 5:
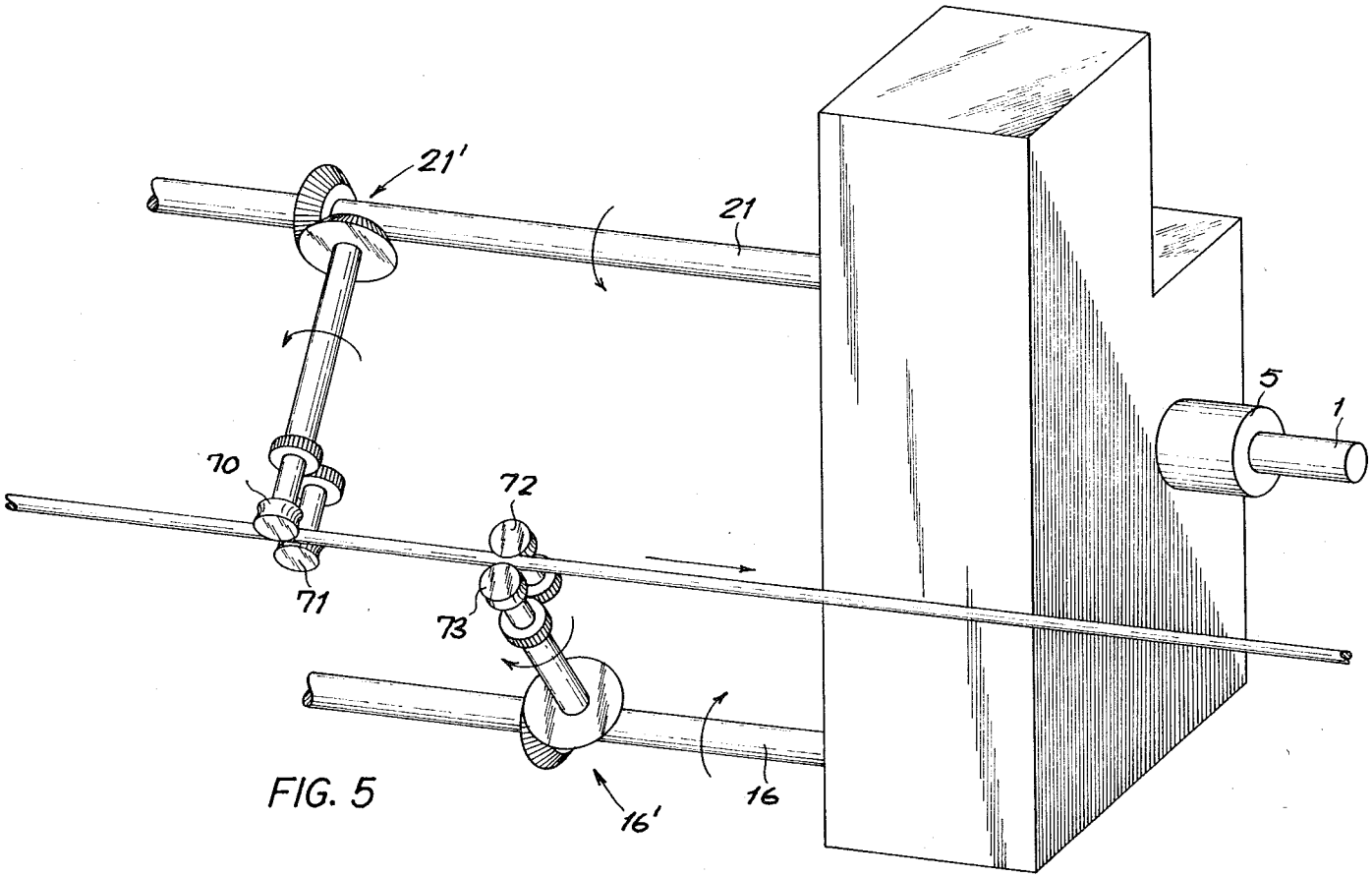
FIG. 5 is a perspective view of a portion of the calibrating stage of the wire rolling line.

With the clutch 5 engaged rolls 70, 71 connected to the output or roll-drive shaft 21 being a bevel gearing 21' (FIG. 5) and the rolls 72, 73 connected to the output or roll-drive shaft 16 by a bevel gearing 16' driven by the drive shaft 1 by the intermeshed gears 2, 8, 14, 12 and 19. Thus the clutch 17 is engaged and the clutches 18 and 22 are disengaged. The output roll drive shaft 16 maintains a rotation speed $n_{u1}$, the output roll drive shaft 21 a rotation speed $n_{01}$ (the "u" subscript representing clockwise rotation and the "o" subscript counterclockwise rotation). The different rotational speeds of the individual roll units lead to for example, diameter reductions of 20 to 22% in the rolling of standard steel.

With the coupling 5 out of engagement the rolls connected to the output drive shafts 16 and 21 are driven by the intermeshed gears 3, 9, 15, 13 and 20. Thus the clutch 17 is disengaged and the clutches 18 and 22 are engaged. The output roll drive shaft 16 maintains a rotational speed $n_{u2}$, the output drive shaft 21 a rotational speed $n_{02}$. The rotational speeds of the individual roll units lead with uniform rotational speed ratios of both drive shafts, $n_{u1}:n_{01}=n_{u2}:n_{02}$ for example to diameter reductions of 16 to 18% in the rolling of stainless steel.

The gearshift according to FIG. 4 is correspondingly structured but does not employ intermediate shafts. The motor drives an input drive shaft 23 on which two gears 24 and 25 are mounted. The gear 25 is keyed on rigidly, the gear 24 releasably by a clutch 26. The gear 24 meshes with the gears 27 and 29, the gear 25 with the gears 28 and 30 on the drive shafts 31 and 32. The gears 27, 28 and 29 are engageable and disengageable by the clutches 33, 34 and 35.

With clutch 26 engaged the rolls connected to the output roll drive shafts 31 and 32 are driven by the intermeshed gears 24, 27 and 29. The clutch 33 is engaged and the clutches 34 and 35 are disengaged. On disengaging clutch 26 the unshown drive shafts are driven by the intermeshed gears 25, 28 and 30. Thus the clutch 33 is disengaged and the clutches 34 and 35 are engaged.

We claim:

1. A roll mill block for rolling a wire to final gauge, comprising:

a plurality of vertical and horizontal roll units displaced alternately at right angles to each other and positioned along a rolling line, each of said roll units comprising:

a pair of working rolls on opposite sides of a wire to be rolled, each successive pair of said roll units being driven with respective speeds, bevel gearing for driving the rolls of a respective pair in opposite directions; and distributing driving means for driving said plurality of vertical and horizontal roll units, said driving means comprising:

an input driving shaft rotatable about an axis of rotation parallel to said rolling line, two output driven shafts extending along said rolling line and being parallel thereto, said output shafts being connected to respective roll units by said bevel gearing, two gear trains between said input shaft and said output shafts; and engaging means for selectively connecting said input drive shaft with both of said output shafts through respective ones of said gear trains and producing different rotational speeds in both of said output shafts but with a fixed speed ratio between said output shafts, depending upon the connected gear train.

2. The roll block defined in claim 1 wherein said selectively engaged means are clutches mounting on said input shaft and said output shafts.

3. The block defined in claim 2 wherein said distributing driving means further comprising:

a plurality of intermediate shafts between said output shafts and said input shaft, said intermediate shafts rotating about respective axes parallel to said axis of rotation, and two intermediate gears mounted on each of said intermediate shafts.

* * * * *